US007475504B2

(12) United States Patent
Leung

(10) Patent No.: US 7,475,504 B2
(45) Date of Patent: Jan. 13, 2009

(54) STEAMER AND HOT IRON APPLIANCE

(75) Inventor: Anthony Kit Lun Leung, North Point (CN)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 11/891,442

(22) Filed: Aug. 10, 2007

(65) Prior Publication Data

US 2008/0040953 A1 Feb. 21, 2008

Related U.S. Application Data

(60) Provisional application No. 60/838,041, filed on Aug. 15, 2006.

(51) Int. Cl.
*D06F 75/20* (2006.01)
*D06C 7/00* (2006.01)

(52) U.S. Cl. ..... 38/75; 38/77.9; 38/77.6

(58) Field of Classification Search ..... 38/74, 38/77.1, 75, 77.3, 77.5, 77.6, 77.83, 77.8, 38/77.9, 84; 68/222

See application file for complete search history.

(56) References Cited

U.S. PATENT DOCUMENTS

| | | | | |
|---|---|---|---|---|
| 5,609,047 | A * | 3/1997 | Hellman et al. | 68/222 |
| 6,061,935 | A * | 5/2000 | Lee | 38/77.6 |
| 6,678,973 | B2 * | 1/2004 | de Mori | 38/77.6 |
| 6,711,840 | B1 * | 3/2004 | Rosenzweig | 38/69 |

FOREIGN PATENT DOCUMENTS

| | | | |
|---|---|---|---|
| FR | 2889212 | * | 1/2006 |
| GB | 2308135 A | * | 6/1997 |

* cited by examiner

*Primary Examiner*—Ismael Izaguirre
(74) *Attorney, Agent, or Firm*—Lawrence Cruz

(57) ABSTRACT

An appliance (10) for ironing and steaming fabric or clothing includes a base (12) housing a water reservoir (124) and boiler (112) for respectively creating steam and operating an iron. A steam outlet port and hose (20), and a steam wand (18) emit steam onto a fabric or garment. A clothing iron (7) is attached to base (12) via an electrical cord/hose combination (24). The base (12) is attached by a single power cord (46) which is plugged into a single electrical outlet which provides power to both the steamer and the iron.

9 Claims, 9 Drawing Sheets

MECHANISM ON T-NOZZLE SIDE

FRONT VIEW

SIDE VIEW

REAR VIEW

3/4 VIEW

TOP VIEW

BOTTOM VIEW

MECHANISM ON T-NOZZLE SIDE

MECHANISM ON STEAM IRON SIDE

STEAMER AND HOT IRON APPLIANCE

CROSS-REFERENCE TO RELATED APPLICATIONS

This application claims the priority of U.S. Provisional Application No. 60/838,041 filed Aug. 15, 2006 and entitled "Steamer and Hot Iron Appliance."

BACKGROUND OF THE INVENTION

1. Field of the Invention

The present invention relates to compact multifunction home appliances for ironing, pressing and steaming items of clothing or fabric.

2. Description of Related Art

Various known appliances exist for pressing, ironing and/or steaming clothing to remove wrinkles and to press creases. Conventional clothing irons typically have a generally flat soleplate made of a heat conductive material so that an electrically powered heat element located adjacent to the soleplate and housed internally can provide heat to the soleplate when activated. Typical clothing irons include steam vents or channel to selectively release steam.

Conventional clothing steamers typically have a water reservoir in communication with an electrically powered boiler for heating water to create steam that is released into a hose and through a wand having steam holes or channels thereon. The steam is directed to the fabric or clothing garment while it is hanging on a hanger.

Both clothing irons and steamers are each better suited than the other for specific applications as is understood by those skilled in the art.

It is desirable to provide a single appliance that incorporates both irons and steamers in an advantageous configuration so that either is conveniently and readily accessible at any given time.

OBJECTS OF THE PRESENT INVENTION

It is an object of the present invention to provide a single appliance that has a clothing iron component and a steamer component to selectively use either component from a convenient and accessible platform. These and other objects are achieved by the present invention.

BRIEF SUMMARY OF THE PRESENT INVENTION

According to the present invention, an appliance comprises a steamer having a base housing, a water reservoir and boiler for selectively creating steam, a steam outlet port and hose, and a steam wand for emitting steam onto a fabric or garment; and a clothing iron attached to the base via an electrical cord, wherein the base is attached by a single power cord to a single electrical outlet which provides power to both the steamer and the iron.

The inventive appliance for steaming and ironing comprises a reservoir for containing water. A heater heating at least a portion of the water contained within the reservoir to boil the water and generate steam. A first hose is coupled to the reservoir to receive the steam. A nozzle is coupled to an output end of the first hose to emit the steam for a steaming operation. A second hose is coupled to the reservoir to receive the water. A pump drives the water from the reservoir. A handheld ironing attachment has a soleplate with a plurality of holes for steam emission. A flash boiler is contained within the ironing attachment. The boiler receives water from the pump and emits steam through the holes.

The reservoir may comprise first and second tanks with 1) the first tank in communication with the first hose, 2) the first tank thermally coupled to the heater, and 3) the second tank not being thermally coupled to the heater. A base housing contains the reservoir and supports a telescoping member for supporting a hanger. A metal plate supports the handheld ironing device.

The heater for heating at least a portion of the water contained within the reservoir to boil the water and generate steam may have temperature override controls to prevent overheating.

The first hose coupled to receive the steam may be coupled to an insulated handle communicating with the nozzle.

The nozzle coupled to an output of the first hose may be elongated and take the configuration of the letter T.

The second hose having an input coupled to receive the water may comprise a hose for conveying water and electrical conductors for conveying power and control signals.

The pump for driving the water from the reservoir has an input coupled to the reservoir and an output coupled to the holes.

The reservoir for containing water comprises first and second tanks, the first tank being coupled to send steam through the first hose and being thermally coupled to the heater, and the second tank not being thermally coupled to the heater, the pump being coupled to the second tank.

The handheld ironing device defining a plurality of holes for steam emission may define the holes in a metallic member. A portion of the housing may be made of plastic.

The flash boiler contained within the handheld ironing device may be coupled to temperature controls.

BRIEF DESCRIPTION OF THE FIGURES

The invention that may be understood from the detailed description below taken in conjunction with the drawings in which.

DETAILED DESCRIPTION OF THE PREFERRED EMBODIMENTS OF THE INVENTION

Figure 1:
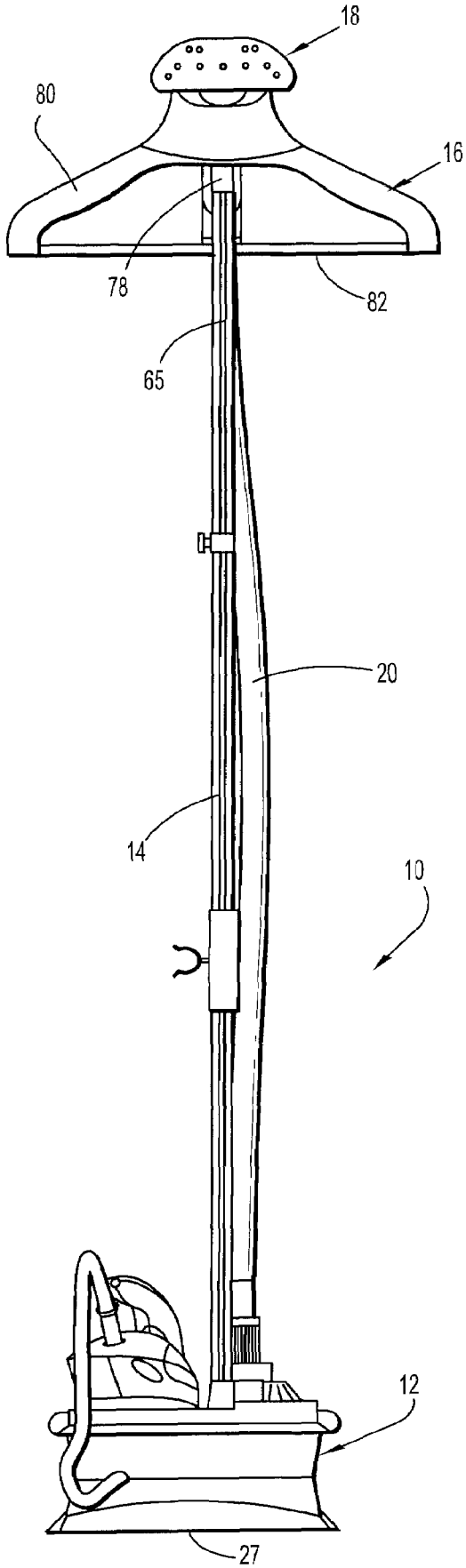
FIG. 1 is a front view of a preferred embodiment of the present invention.

As shown in FIGS. 1 through 11, an appliance (10) according to the present invention is illustrated. Generally, appliance (10) has a base (12). A telescoping post (14) is supported on base (12). Support for an item of clothing or other item to be steamed is provided by a hanger (16) secured to the top of post (14).

A steam providing wand (18) is coupled by a steam providing hose (20) to a source of steam in base (12). Wand (18) rests on hanger (16), as illustrated in FIG. 1.

Figure 4:
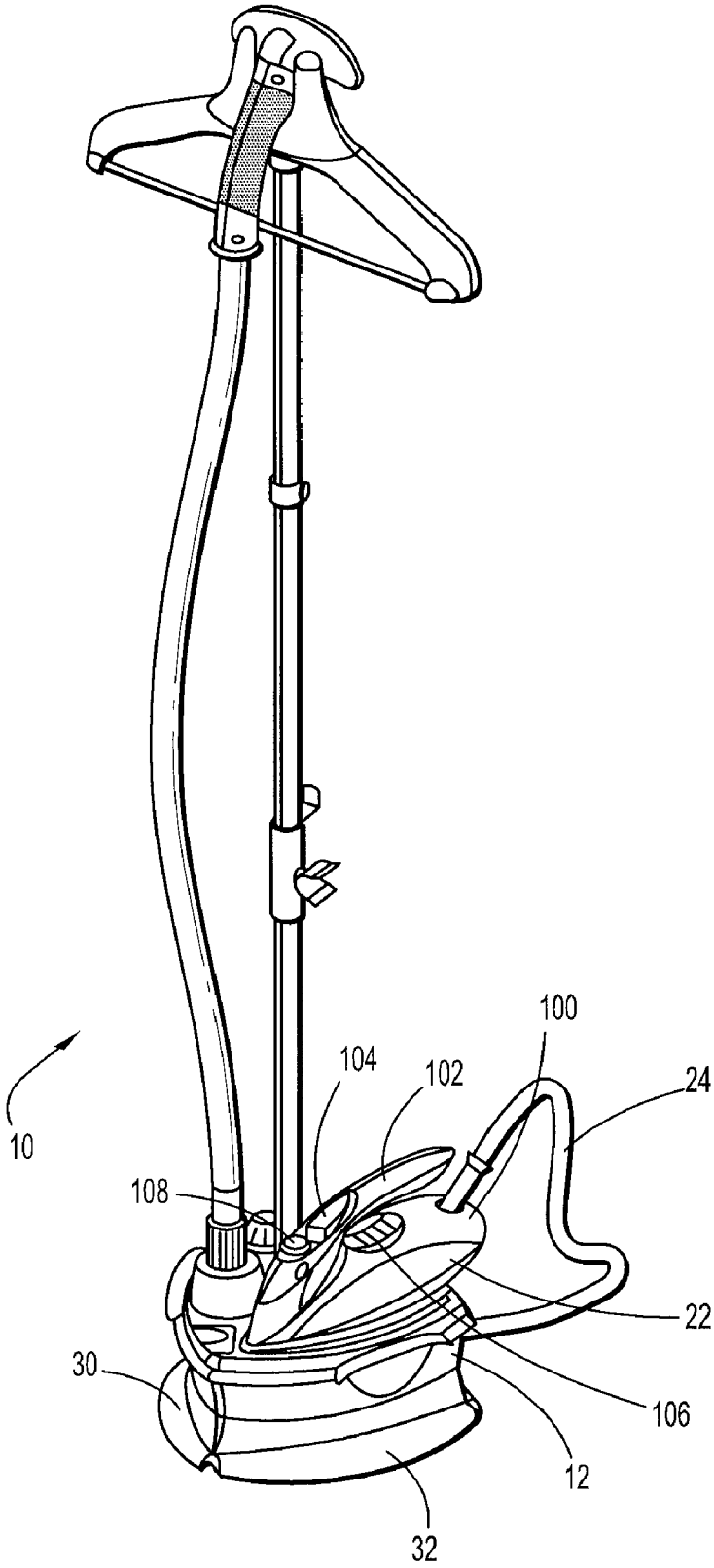
FIG. 4 is frontal three-quarters view of a preferred embodiment of the present invention.

A clothing iron (22) (FIG. 3) rests on base (12) when not in use. Iron (22) is connected by a cord (24) to base (12), as illustrated in FIG. 4. Cord (24) provides iron (22) with electricity and water, which are both employed during an ironing procedure.

Figure 5:
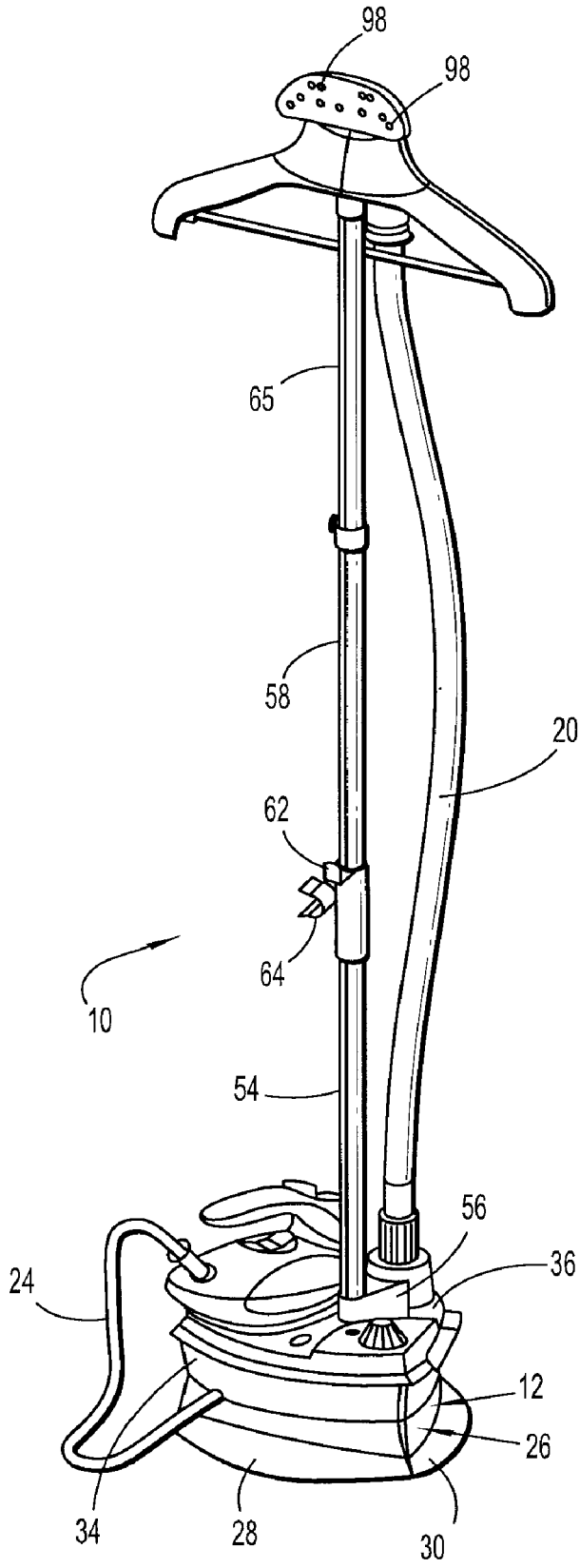
FIG. 5 is a rear three-quarters view of a preferred embodiment of the present invention showing the iron positioned on the base.

Referring to FIGS. 4 and 5, base (12) comprises a foot (26) having three extensions (28), (30) and (32), as illustrated. The bottom surface (27) of foot (26) is flat, allowing it to rest on any suitable surface, such as a table, a floor, and so forth. Extensions (28), (30) and (32) extend from base (26) to impart stability to appliance (10). Base (12) may be made in whole or in part of a relatively heavy material, also imparting stability to appliance (10). Foot (26) supports a base housing (34). Base housing (34) defines an internal volume for the housing of various subsystems of appliance (10) as will be detailed below. Base housing (34) may be made of any suitable material, such as relatively light gauge sheet metal or a rigid plastic customarily used in heated appliances.

Figure 6:
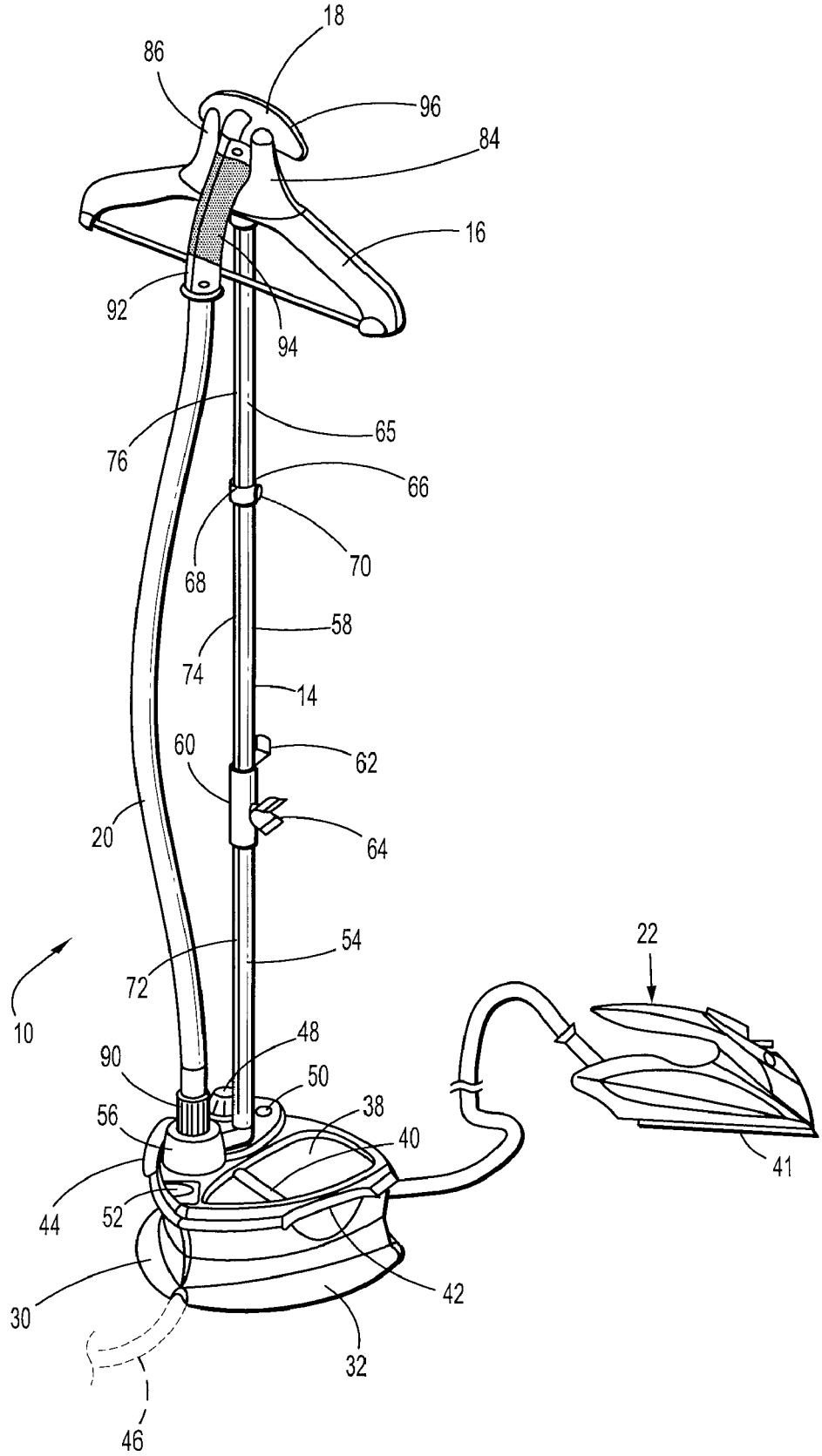
FIG. 6 is a view similar to that of FIG. 4 of a preferred embodiment of the present invention showing the iron displaced off the base.

Base housing (34) is closed by a top plate (36), which mates with the open top of base housing (34). Referring to FIG. 6, top plate (36) defines a tray (38) for receiving iron (22). Tray (38) incorporates a ridge (40) which serves the purpose of creating an airspace between the bottom (41) of iron (22) and the facing surfaces of tray (38) when iron (22) is in the position illustrated in, for example, FIG. 1. The object is to prevent heat from iron (22) from being lost by being conducted away from iron (22), thus reducing the ability of iron (22) to iron and press garments.

Figure 7:
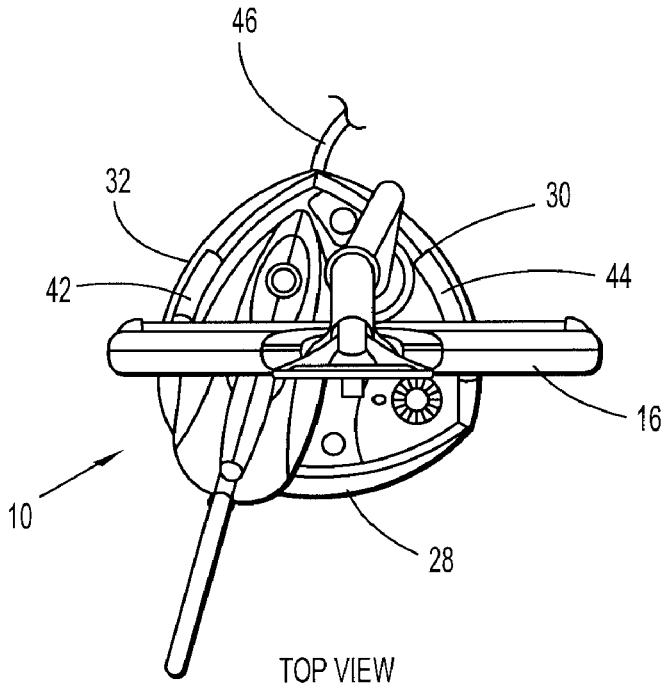
FIG. 7 is a top view of a preferred embodiment of the present invention.
Figure 8:
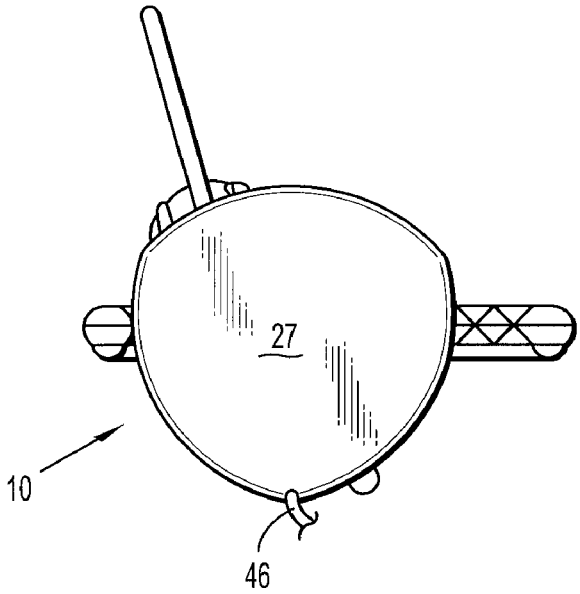
FIG. 8 is a bottom view of a preferred embodiment of the present invention showing the iron positioned on the base.

As shown in FIGS. 6 and 7, base housing (34) includes a pair of handles (42) and (44), which are configured to be easily grasped by a user and moved to any desired location. As illustrated in FIG. 8, power to the system is provided by a power cord (46) which is terminated in a plug which mates with a standard household alternating current socket.

A knob (48) coupled to a selector switch mounted on top plate (36), as will be discussed in detail below, controls selective actuation of power to the systems driving steamer wand (18) or iron (22). Top plate (36) also receives caps (50) and (52) which close water-containing tanks.

Figure 2:
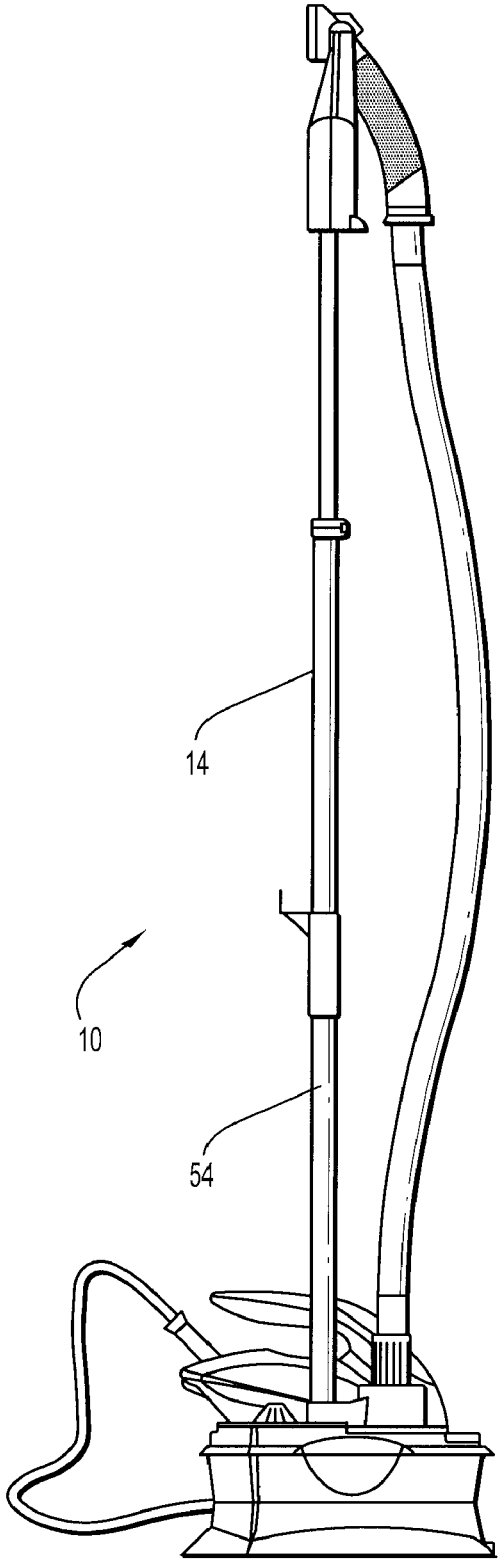
FIG. 2 is a side view of a preferred embodiment of the present invention.
Figure 3:
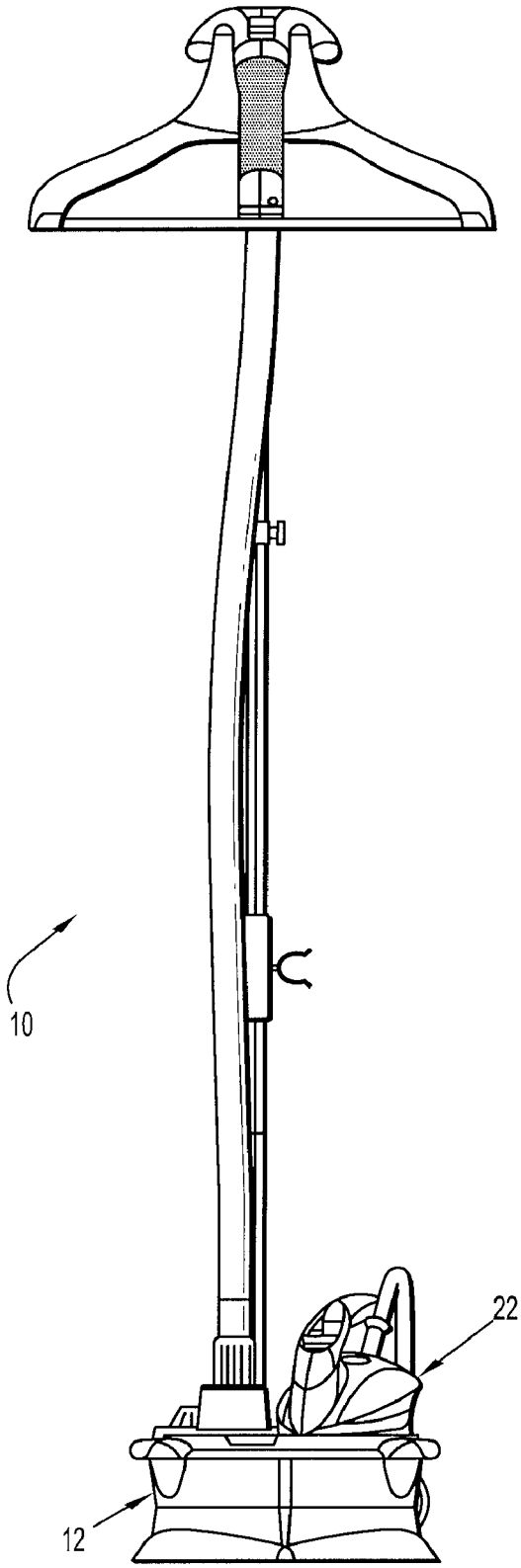
FIG. 3 is a rear view of a preferred embodiment of the present invention showing the iron located on the base.

As illustrated most clearly in FIG. 2, post (14) comprises a first telescoping section (54), which is mounted on and extends from a support structure (56) (FIG. 5) mounted on or integral with top plate (36). Support structure (56) may be made of plastic or any suitable material and may (if not integral with top plate (36)) be secured to top plate (36) by any suitable mains, such as a bolt, or latching flexible press fit engagement structure of conventional design. Support structure (56) may be made of solid plastic or it may be hollow.

As can be seen in FIG. 5, a second telescoping section (58) is disposed in and extends from first telescoping section (54). The position of telescoping section (58) may be fixed with respect to telescoping section (54) by any suitable mechanical latching member of the type used, for example, on compact camera tripods. In accordance with the present invention, a latch (60) carries an L-shaped hook (62) for supporting cord (24). Latch (60) also carries a clip (64), which may be used to support hose (20).

A third telescoping section (65) is positioned in and extends from telescoping section (58). Telescoping section (65) is locked in position with respect to telescoping section (58) by a suitable latch, such as a cam latch (66), as illustrated most clearly in FIG. 6. Cam latch (66) comprises a collar (68). A cam member (70) is rotatably mounted in collar (68) and when rotated to the position illustrated in FIG. 6, grippingly engages telescoping section (65) and locks it in position with respect to telescoping section (58).

During storage, telescoping section (65) is positioned within telescoping section (58), which in turn is positioned within telescoping section (54). Grooves (72), (74) and (76) are located in sections (54), (58) and (65) and mate with each other to maintain alignment between the base (12), the telescoping sections of post (14) and hanger (16).

As illustrated most clearly in FIG. 1, hanger (16) is secured at the top of telescoping section (65) by a support member (78). Support member (78) is made of plastic and may be molded integrally with hanger body (80) and hanger crossbar (82). Telescoping section (65) may be secured by epoxy glue or any other suitable means within support member (78). As illustrated most clearly in FIG. 6, hanger (16) includes a pair of fingers (84) and (86) for supporting steaming wand (18).

Figure 9:
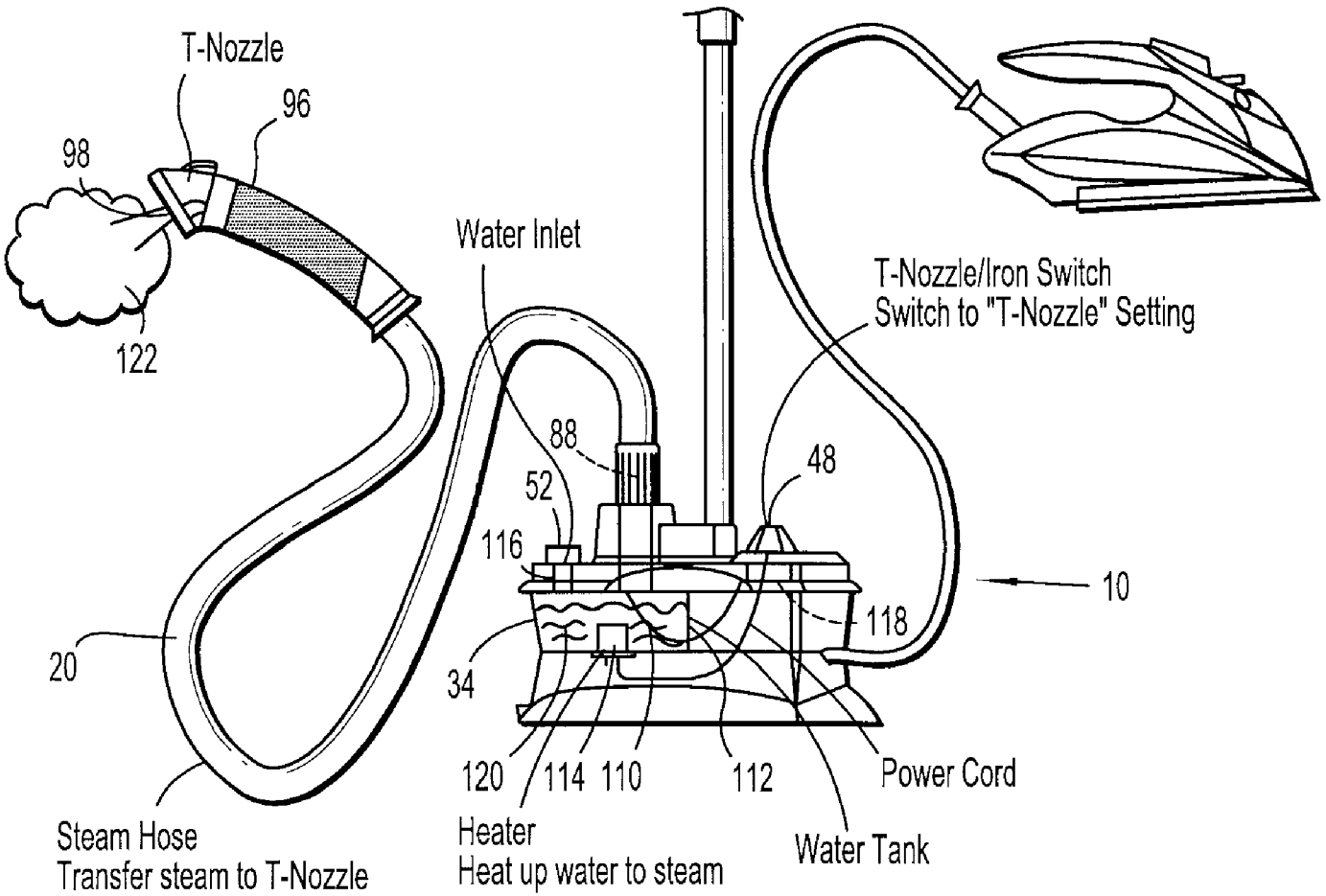
FIG. 9 is a schematic illustration of a preferred embodiment of the present invention showing the steamer subsystem.

Support (56) also includes an upwardly extending threaded nipple (88) as illustrated most clearly in FIG. 9. Nipple (88) functions as an output stream port for steaming, as appears more fully below. Referring back to FIG. 6, nipple (88) supports threaded locking sleeve (90). Sleeve (90) secures the lower end of hose (20) to the source of steam for steaming provided in accordance with the present invention, as will be described in detail below.

Hose (20) is, in turn, coupled to a handle (92) which includes a section bearing helical or annular grooves (94). At least that portion of handle (92) bearing grooves (94) is made of an insulative material to allow grasping of handle (92) during use without excessive heat being felt by the user. Handle (92) may be formed integrally with T-nozzle (96), which rests on support fingers (84) and (86), as illustrated in FIG. 6, when not in use. T-nozzle (96) defines vents (98) which output steam during use.

Referring to FIG. 4, iron (22) includes a main body (100) and a handle (102). The release of steam by iron (22) is actuated by an operator (104). A display (106) may be used to indicate temperature which may be controlled by a conventional control coupled to a knob (108). When not in use iron (22) is positioned as illustrated in FIG. 4, resting in tray (38).

Referring to FIG. 9, the operation of the steamer portion of the inventive system may be understood. Base housing (34) contains a boiler (110) which comprises a water tank (112) and a heating element (114). Tank (112) is filled through a conduit (116). Conduit (116) is closed by cap (52). Switch (48) is coupled to a selector switch (118).

When power is routed by selector switch (118) to heating element (114) which corresponds to a steaming operation, water (120) contained in tank (112) is heated to the boiling point resulting in the generation of steam which is piped through hose (20) to vents (98) of T-nozzle (96), resulting in the output of a cloud of steam (122). In accordance with the preferred embodiment of the invention, heating element (114) is controlled by a temperature sensitive device which prevents overheating and potentially hazardous conditions.

Cord (24) includes electrical wires (130) and a water hose (132). Electrical wires (130) include wires coupled to electrical water pump (134) and wires carrying power from base (12) to flash boiler (136). The input of water hose (132) is coupled to the output of pump (134) whose input is, in turn, coupled to tank (124).

When it is desired to steam clothing or another article, knob (48) is put in a position which results in the application of electrical power from power cord (46) to power heater (114).

This results in heating water (120) to the boiling point and the generation of steam which is output through hose (22) and emitted by T-nozzle (96), results in the generation of steam (122). T-nozzle (96) may then be run over a surface which one desires to steam, for example, the wrinkled surface of a pair of pants.

In accordance with the present invention, steam may be provided under substantial pressure so that it forms into jets, or substantially at atmospheric pressure.

Alternatively, boiler tank (112) may be replaced by a flash boiler to generate steam under pressure. If steam is generated under pressure, this may result in driving steam deep into the fabric.

It is also contemplated in accordance with the present invention that a shroud may be placed over an item being steamed with the steamer in the position illustrated in FIG. 1, resulting in the accumulation of a cloud of steam around, through and inside the garment being steamed.

Figure 10:
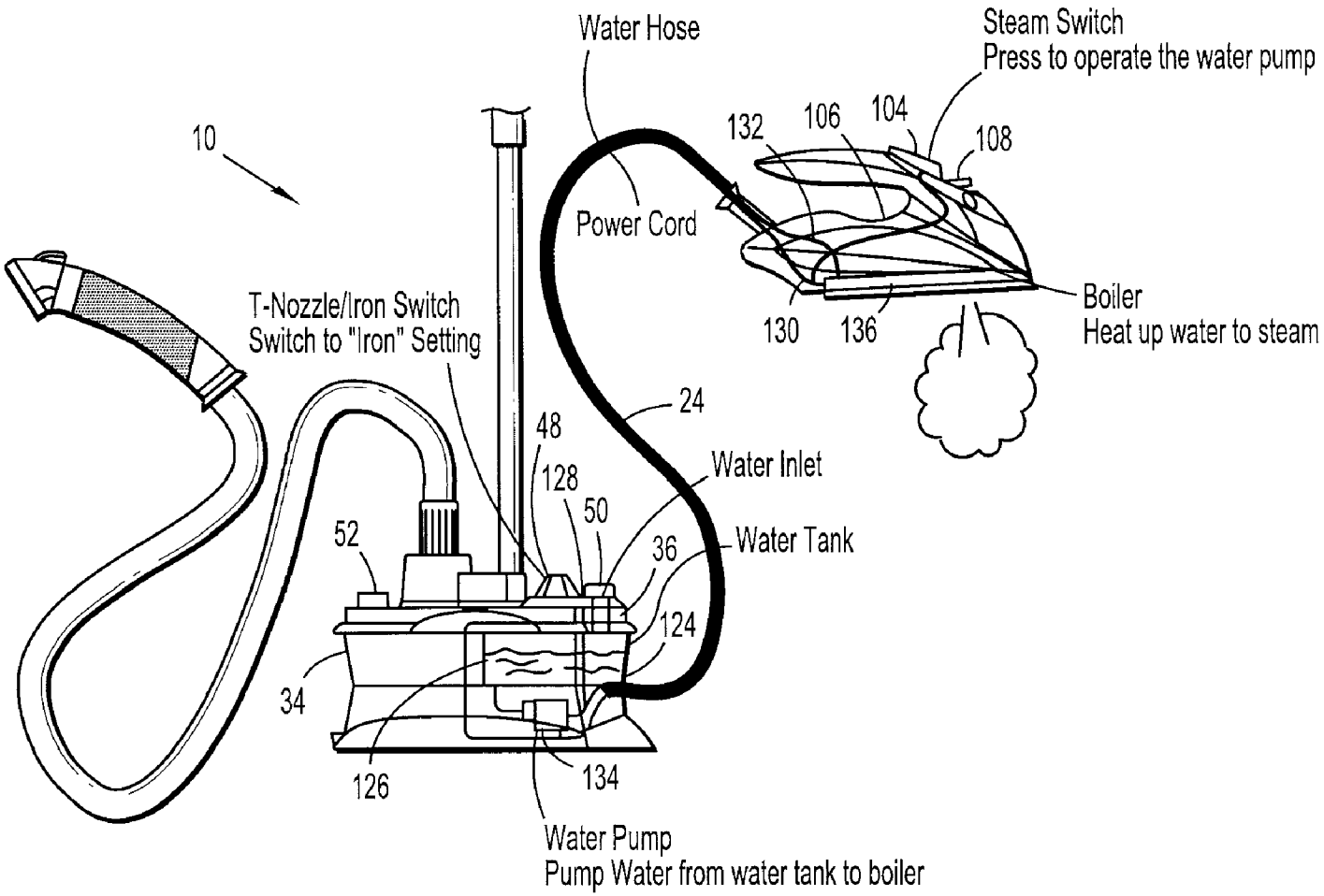
FIG. 10 is a schematic illustration of a preferred embodiment of the present invention showing the iron subsystem.

Referring to FIG. 10, the operation of the iron portion of the inventive system may be understood. Base housing (34) contains a water supply tank (124). Water supply tank (124) is filled with water (126) through pipe (128), and closed by cap (50).

When it is desired to iron a garment, knob (48) is put in the position where power is applied to the wiring associated with pump (134) and actuator switch (104). Next, after the flash boiler has reached its proper operating temperature, as indicated by indicator (106), actuator switch (104) is depressed, resulting in the application of power to pump (134) which pumps water (126) from tank (124) into flash boiler (136). Flash boiler (136) is maintained at a desired temperature by a conventional temperature controlling device whose set point is adjusted by rotation of knob (108).

As an alternative to the above described structure, the escape of steam from T-nozzle (96) may be controlled by a finger actuated valve. It is also contemplated that switch (118) may allow simultaneous actuation and use of both steaming and ironing appliances at the same time.

It is also contemplated that a single boiler may be used to boil water for output through wand (18), and that water in such a single boiler may be pumped by pump (134) to flash boiler (136). It is also contemplated that electrical pump (134) may be replaced by a manually powered pump. It is still further contemplated in accordance with the present invention that steam generated by a single boiler may be used for ironing and steaming. This could be done by directly coupling the steam through a hose which couples that steam to the iron for use during ironing and pressing.

The invention claimed is:

1. An appliance for steaming and ironing, comprising:

(a) a reservoir for containing water;

(b) a heater for heating at least a portion of the water contained within said reservoir to boil said water and to generate steam;

(c) a first hose coupled to said reservoir and in communication with said reservoir;

(d) a nozzle coupled to said first hose for emitting steam therefrom;

(e) a second hose coupled to said reservoir;

(f) a pump for driving said water from said reservoir through said second hose;

(g) a handheld ironing device having a plurality of holes for steam emission; and (h) a flash boiler contained within said handheld ironing device, said boiler being coupled to said second hose to receive water from said pump and to emit steam through said holes.

2. An appliance for steaming and ironing as in claim 1, wherein said flash boiler contained within said handheld ironing device is coupled to temperature controls.

3. An appliance for steaming and ironing, comprising (a) a reservoir for containing water;

(b) a heater for heating at least a portion of the water contained within said reservoir to boil said water and to generate steam;

(c) a first hose coupled to said reservoir and in communication with said reservoir;

(d) a nozzle coupled to said first hose for emitting steam therefrom;

(e) a second hose coupled to said reservoir;

(f) a pump for driving said water from said reservoir through said second hose;

(g) a handheld ironing device having a plurality of holes for steam emission; and (h) a flash boiler contained within said handheld ironing device, said boiler being coupled to said second hose to receive water from said pump and to emit steam through said holes, wherein said reservoir comprises first and second tanks, said first tank being coupled to said first hose to send steam and said first tank being thermally coupled to said heater.

4. An appliance for steaming and ironing as in claim 3, wherein said heater override controls for automatically preventing overheating.

5. An appliance for steaming and ironing as in claim 3, wherein said first hose is coupled to an insulated handle communicating with said nozzle.

6. An appliance for steaming and ironing as in claim 5, wherein said nozzle is generally T-shaped.

7. An appliance for steaming and ironing as in claim 3, wherein said a second hose comprises a conduit for housing electrical conductors for conveying power and control signals to said handheld ironing device.

8. An appliance for steaming and ironing as in claim 3, wherein said flash boiler contained within said handheld ironing device is coupled to temperature controls.

9. An appliance for steaming and ironing, comprising (a) a reservoir for containing water;

(b) a heater for heating at least a portion of the water contained within said reservoir to boil said water and to generate steam;

(c) a first hose coupled to said reservoir and in communication with said reservoir;

(d) a nozzle coupled to said first hose for emitting steam therefrom;

(e) a second hose coupled to said reservoir;

(f) a pump for driving said water from said reservoir through said second hose;

(g) a handheld ironing device having a plurality of holes for steam emission; and (h) a flash boiler contained within said handheld ironing device, said boiler being coupled to said second hose to receive water from said pump and to emit steam through said holes, wherein said reservoir comprises first and second tanks, said first tank being coupled to said first hose and being thermally coupled to said heater, said pump being coupled to said second tank, and wherein said handheld ironing device has a plurality of holes for steam emission.

* * * * *